US010183790B2

(12) United States Patent
Flood et al.

(10) Patent No.: US 10,183,790 B2
(45) Date of Patent: Jan. 22, 2019

(54) NON-REMOVABLE CLOSURE CAP WITH A COLLAR

(71) Applicant: Berlin Packaging, LLC, Chicago, IL (US)

(72) Inventors: Nora Flood, Chicago, IL (US); Brett Niggel, Chicago, IL (US)

(73) Assignee: Berlin Packaging, LLC, Chicago, IL (US)

( * ) Notice: Subject to any disclaimer, the term of this patent is extended or adjusted under 35 U.S.C. 154(b) by 106 days.

(21) Appl. No.: 15/361,841

(22) Filed: Nov. 28, 2016

(65) Prior Publication Data

US 2018/0148236 A1 May 31, 2018

(51) Int. Cl.
*B65D 49/00* (2006.01)
*B65D 1/02* (2006.01)
*B65D 41/04* (2006.01)

(52) U.S. Cl.
CPC ..... *B65D 49/00* (2013.01); *B65D 1/0246* (2013.01); *B65D 41/0471* (2013.01)

(58) Field of Classification Search
CPC .. B65D 49/00; B65D 1/0246; B65D 41/0471; B65D 2255/20; B65D 55/00; B65D 44/022; B05B 11/0008; B05B 11/3043; B05B 11/3045; B05B 11/3046; B05B 11/3047
USPC ..... 222/147, 153.1, 153.09, 321.9
See application file for complete search history.

(56) References Cited

U.S. PATENT DOCUMENTS 2,124,638 A * 7/1938 Sheldon ..... B65D 41/3419 215/252
2,409,846 A * 10/1946 Greene ..... B65D 49/06 215/253
3,390,799 A * 7/1968 Szekely ..... B65D 55/022 215/221
RE27,673 E * 6/1973 Landen ..... B65D 55/022 215/221
4,345,691 A * 8/1982 Burke ..... B05B 11/3045 215/216
4,347,939 A * 9/1982 Upton ..... B65D 41/045 215/252
4,464,316 A * 8/1984 Michaels ..... B65D 41/0471 128/200.11
4,533,058 A * 8/1985 Uhlig ..... B65D 47/0838 215/211

(Continued)

*Primary Examiner* — Paul R Durand
*Assistant Examiner* — Michael J Melaragno
(74) *Attorney, Agent, or Firm* — Adam K. Sacharoff; Much Shelist, P.C.

(57) ABSTRACT

In one embodiment there is provided a closed non-refillable dispenser having a bottle configured to hold a liquid with a neck surrounding an opening for access to the liquid, and having a pump assembly fitted to the neck to manually pump liquid out of the bottle. The dispenser further having a closure cap fitted over the neck of the bottle and having a central closure opening to receive the pump assembly and a collar seated entirely over the closure cap. The collar and closure cap have corresponding engaging means configured to tighten the closure cap onto the neck when the collar is rotated clockwise and the collar being further configured to not engage the closure cap when the collar is rotated counter-clockwise, such that the closure cap is non-removably affixed to the bottle, thereby preventing the bottle from being refillable.

15 Claims, 10 Drawing Sheets

(56) References Cited

U.S. PATENT DOCUMENTS 4,576,315 A * 3/1986 Vitale ..... B65D 83/40 220/915
4,662,542 A * 5/1987 Vitale ..... B65D 83/40 220/915
4,705,181 A * 11/1987 Burke ..... B65D 50/041 215/213
4,711,363 A * 12/1987 Marino ..... B65D 47/0847 215/237
5,016,780 A * 5/1991 Moretti ..... B05B 11/3001 222/153.13
5,064,102 A * 11/1991 Montaner ..... B05B 11/0013 222/147
5,169,033 A * 12/1992 Shay ..... B05B 11/3045 215/216
5,251,788 A * 10/1993 Moore ..... B65D 41/26 215/330
5,257,724 A * 11/1993 Steijns ..... B05B 11/3045 222/153.06
5,360,127 A * 11/1994 Barriac ..... B05B 11/0008 215/263
5,938,082 A * 8/1999 Foster ..... B05B 11/001 215/318
6,186,364 B1 * 2/2001 Dobbs ..... B05B 11/3019 222/153.13
6,672,488 B2 * 1/2004 de Pous ..... B05B 11/3049 222/321.9
7,780,043 B2 * 8/2010 Jourdin ..... B05B 11/3049 215/273
8,474,657 B2 * 7/2013 Szekely ..... B65D 47/40 215/329
8,544,690 B2 * 10/2013 Garcia ..... B05B 11/0013 222/147
8,544,694 B2 * 10/2013 Waitz ..... B65D 50/046 222/153.1
8,550,311 B2 * 10/2013 Cornet ..... B05B 11/3049 222/153.1
8,561,849 B1 * 10/2013 Wang ..... B05B 7/0037 222/145.5
2001/0032864 A1 * 10/2001 Shepherd ..... B05B 11/0037 222/321.5
2001/0054624 A1 * 12/2001 Jourdin ..... B05B 11/3049 222/321.7
2006/0081655 A1 * 4/2006 Beranger ..... B05B 11/3049 222/321.9
2006/0207960 A1 * 9/2006 Bastero Lopez .. B65D 41/3409 215/331
2006/0273115 A1 * 12/2006 De Pous ..... B05B 11/0008 222/321.9
2010/0219209 A1 * 9/2010 Ding ..... B05B 11/3001 222/321.9
2012/0024909 A1 * 2/2012 Carta ..... B05B 11/0016 222/321.9
2014/0084027 A1 * 3/2014 Wang ..... B05B 11/0008 222/153.13
2014/0332494 A1 * 11/2014 Balakier ..... A61J 7/04 215/365
2017/0233150 A1 * 8/2017 Sims ..... B65D 43/0231 215/44

* cited by examiner

NON-REMOVABLE CLOSURE CAP WITH A COLLAR

FIELD OF THE INVENTION

The present invention relates to dispensers, and particularly to a Closure Cap with a Collar specifically fitted to be non-removably fixed to a dispenser.

BACKGROUND OF THE INVENTION

Manually operated pump dispensers are typically attached to containers with a liquid. In most circumstances the closure cap is removably attached to the containers to allow the containers to be refilled or replaced. The removable closure caps will also typically include a child resistant or tamper resistant closure, however, with the correct amount of pressure or when pressure is applied to a specific location the tamper resistant closures are configured to be removed from the dispenser. In very few instances is it necessary to have a non-removable closure cap. In this unique instance, the closure cap must be capable of being initially applied and fixed to the dispenser. After being fixed thereto, the closure cap must then be non-removable Therefore, there is a need over the prior art to an invention that is capable of providing a non-removable closure cap once it is fixed to a dispenser.

SUMMARY OF THE INVENTION

In one embodiment of the present invention there is provided a closed non-refillable dispenser. The dispenser in one embodiment includes a bottle configured to hold a liquid and having a neck with a thread portion. The neck further surrounding an opening for access to the liquid. The dispenser also includes a pump assembly fitted to the neck of the bottle and configured to manually pump liquid out of the bottle. The dispenser also has a closure cap and a collar. The closure cap is fitted over the neck of the bottle and has a central closure opening to receive the pump assembly. The collar is seated entirely over the closure cap. The collar and the closure cap have corresponding engaging means configured to tighten the closure cap onto the neck when the collar is rotated in a clockwise direction. The collar is further configured to not engage the closure cap when the collar is rotated in a counter-clockwise direction such that the closure cap is non-removably affixed to the bottle, thereby preventing the bottle from being refillable.

In another aspect of the embodiment, the closure cap includes a top ledge having an inner terminal edge configured to define the central closure opening, the top ledge further having an outer terminal edge. A side wall extends downwardly from the outer terminal edge to a lower edge of the closure cap and an annular flange extends outwardly from the lower edge of the side wall. In another aspect of the embodiment, the side wall of the closure cap is further defined to have an upper side wall section and a lower side wall projection section that is projected outwardly by a lip from the upper side wall section.

In another aspect of the embodiment, the dispenser further includes an inner skirt extending downwardly from the inner terminal edge of the top ledge to define an interior channel between the inner skirt and the side wall. The interior channel is configured to capture a portion of the neck of the bottle when placed thereon.

In another aspect of the embodiment, the dispenser includes mating threads on an interior surface of the side wall and on an exterior surface of the neck of the bottle.

In another aspect of the embodiment, the top ledge of the closure cap further includes a plurality of ramps. Each ramp has an entrance portion that is substantially flush with a surface area of the top ledge. Each ramp is also defined as an arcuate segmented ramp that extends in a counterclockwise direction about the top ledge and increases in height from the entrance portion to a terminus end. In yet other aspects, the terminus end of each ramp is approximately 1.5 mm in height from the top ledge. Further embodiments may provide for each ramp extending around the top ledge for about 100 degrees. In yet other embodiments each ramp may have a pitch defined as: 5.4 mm pitch/revolution or each ramp may have a helix angle of 2.89 degrees. In other embodiments, each ramp may be defined as having a pair of legs separately increasing in height from the entrance portion and extending in arcuate segments around the top edge to a segment that joins the two legs at the terminus end.

The collar may also be defined to include a collar top with an inside terminal edge to define a collar opening configured to fit around a portion of the pump assembly and over the central closure opening of the closure cap. A shoulder section extending from the collar top to a downwardly extending collar wall and a bottom collar retaining edge inwardly protruding from a lower interior surface defined about the collar wall. A plurality of interior cap protrusions extend inwardly from an upper interior surface defined about the collar top and shoulder section. Each of the ramps has a corresponding interior cap protrusion, and when the collar is pressed downwardly towards the closure cap and rotated in the clockwise direction the cap protrusions engage the terminus ends of the ramps such that the closure cap rotates clockwise to tighten about the bottle, but when the collar is rotated in a counterclockwise direction the collar slips over the ramps preventing rotation of the closure cap in a counterclockwise direction, thereby defining a closure cap that is non-removably affixed to the bottle. Each of the cap protrusions includes a secondary protrusion member extending along an interior surface portion of the shoulder section, and wherein the secondary protrusion members are defined to position against an upper section of the side wall to center the closure cap around the neck.

One or more of the embodiments may also be defined to have the protruding bottom collar retaining edge extending inwardly to define a snap over fit engagement with the annular flange of the lower edge of the side wall such that the collar is non-removable from the closure cap.

In yet other embodiments, there is provided a non-removable closure cap assembly for use with a non-refillable dispenser. The closure cap assembly includes a closure cap fitted over the neck of the bottle and having a central closure opening to receive the pump assembly, and a collar seated entirely over the closure cap. The collar and the closure cap have corresponding engaging means configured to tighten the closure cap onto the neck when the collar is rotated in a clockwise direction and the collar being further configured to not engage the closure cap when the collar is rotated in a counter-clockwise direction such that the closure cap is non-removably affixed to the bottle, thereby preventing the bottle from being refillable.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
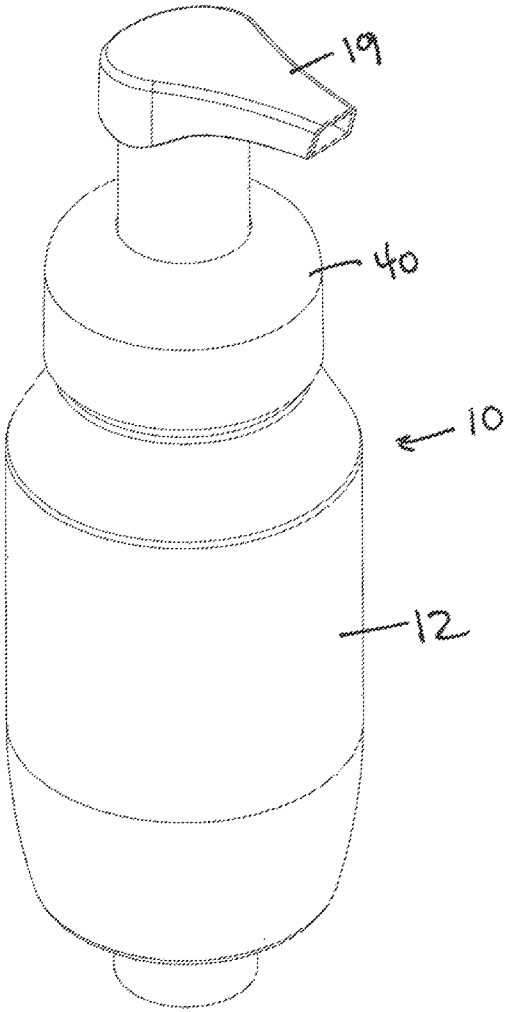
FIG. 1 is a perspective view of a dispenser incorporating a non-removably closure cap with a collar in accordance with an embodiment of the present invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
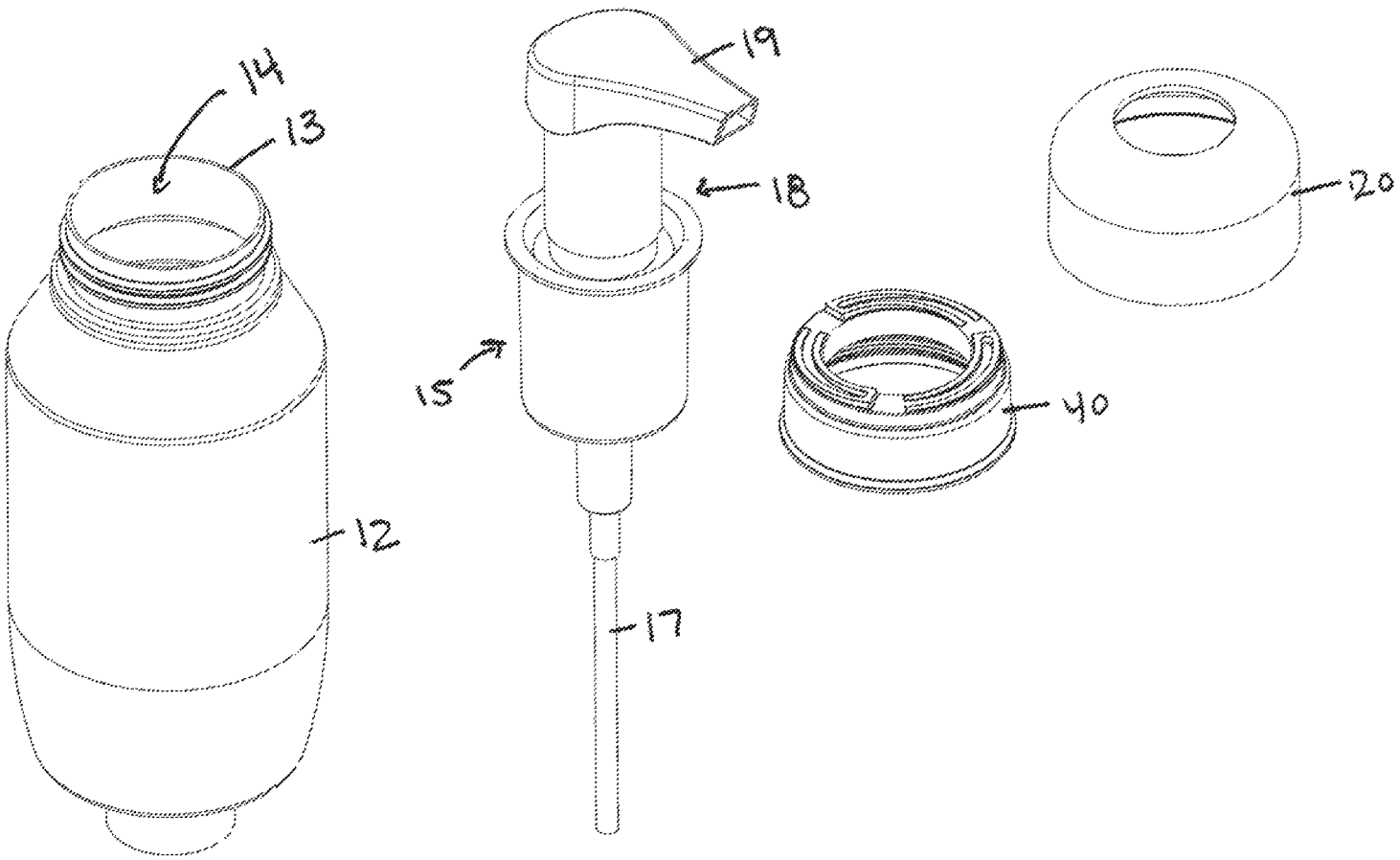
FIG. 2 is a partial exploded view of the dispenser from FIG. 1.
Figure 3:
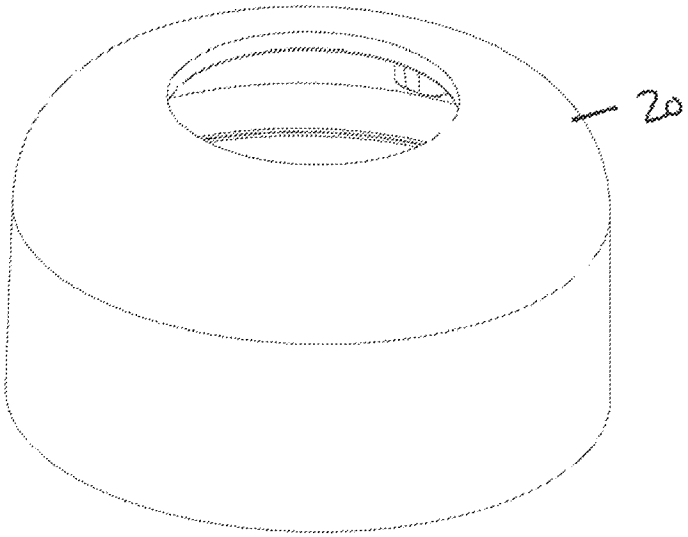
FIG. 3 is an exploded view of the closure cap and collar in accordance with an embodiment of the present invention.
Figure 3:
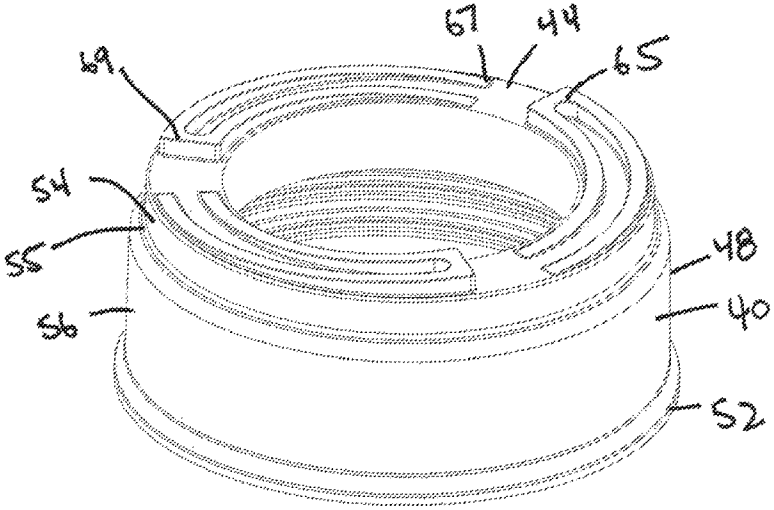
Figure 4:
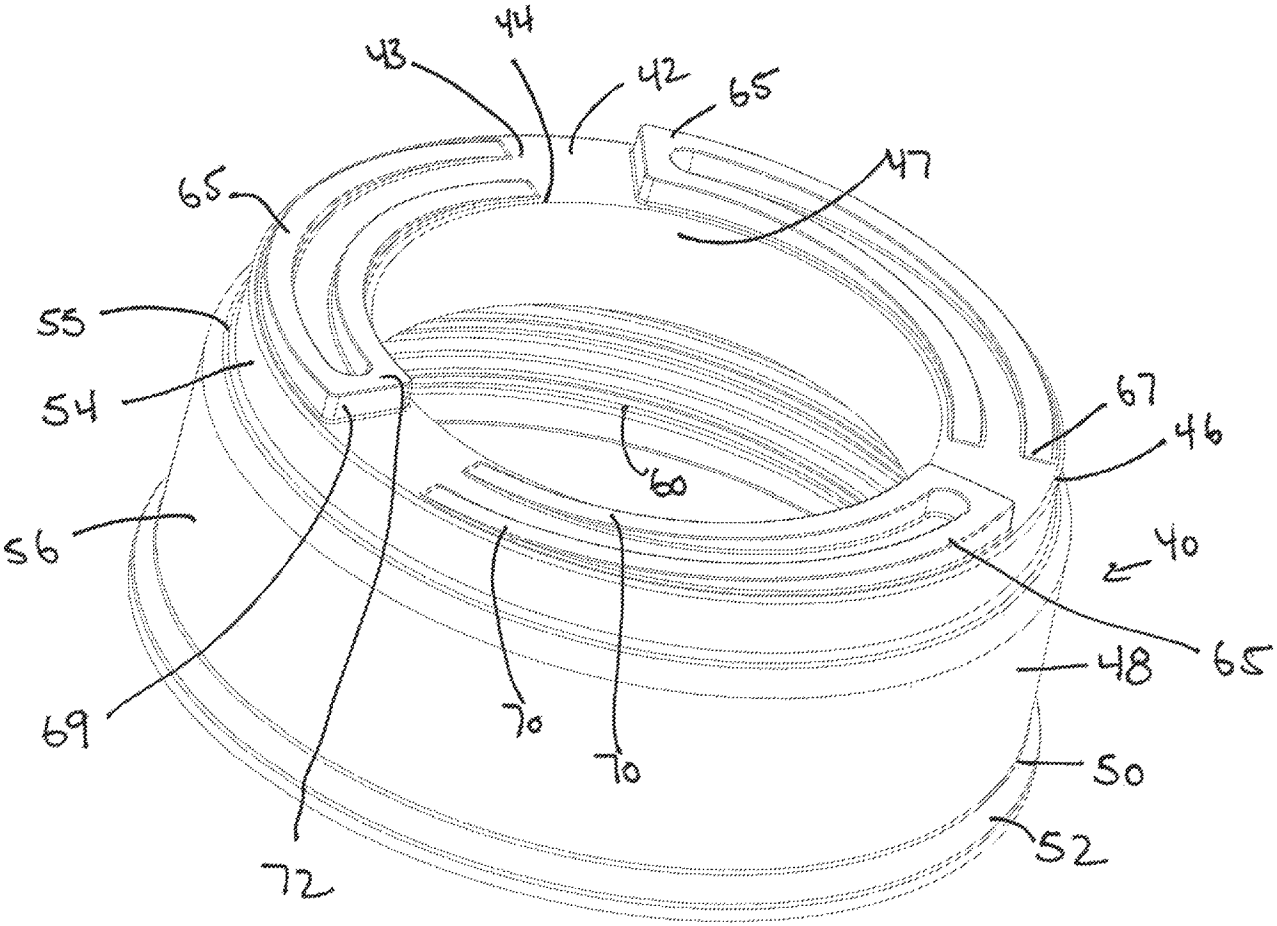
FIG. 4 is an enlarged view of the closure cap in accordance with an embodiment of the present invention.
Figure 5:
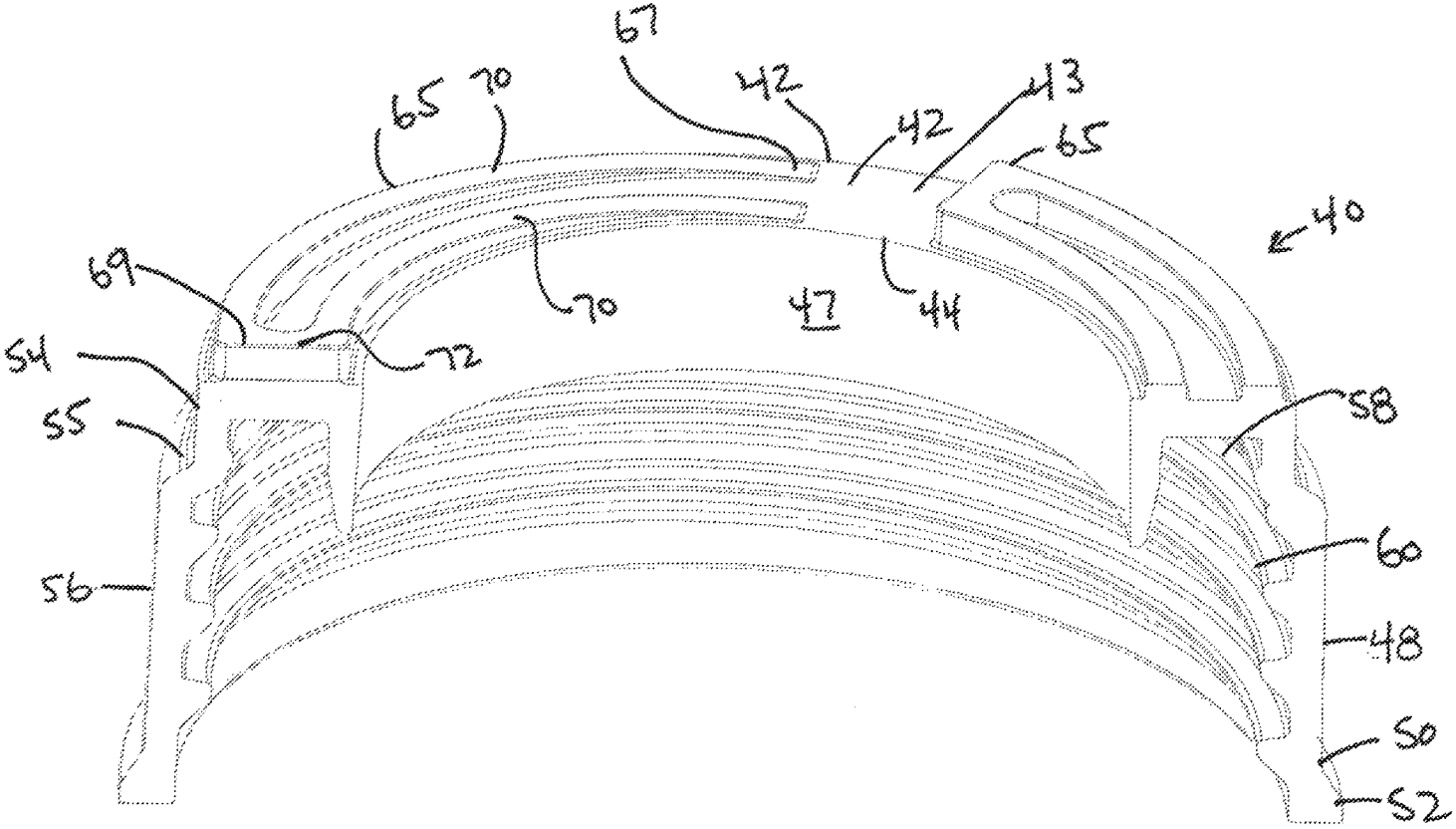
FIG. 5 is a sectional view of the closure cap in accordance with an embodiment of the present invention.
Figure 6:
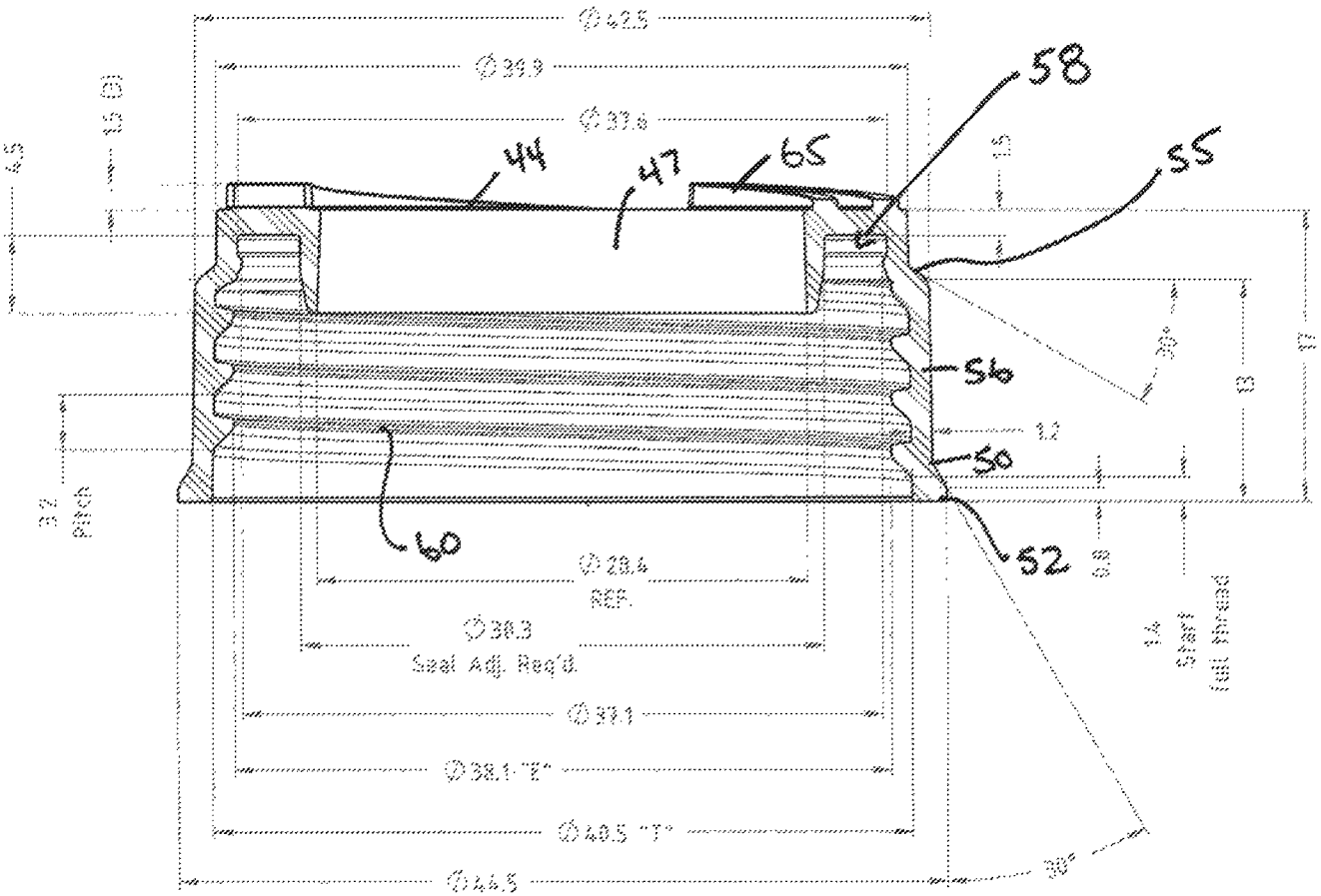
FIG. 6 is another sectional view of the closure cap in accordance with an embodiment of the present invention.
Figure 7:
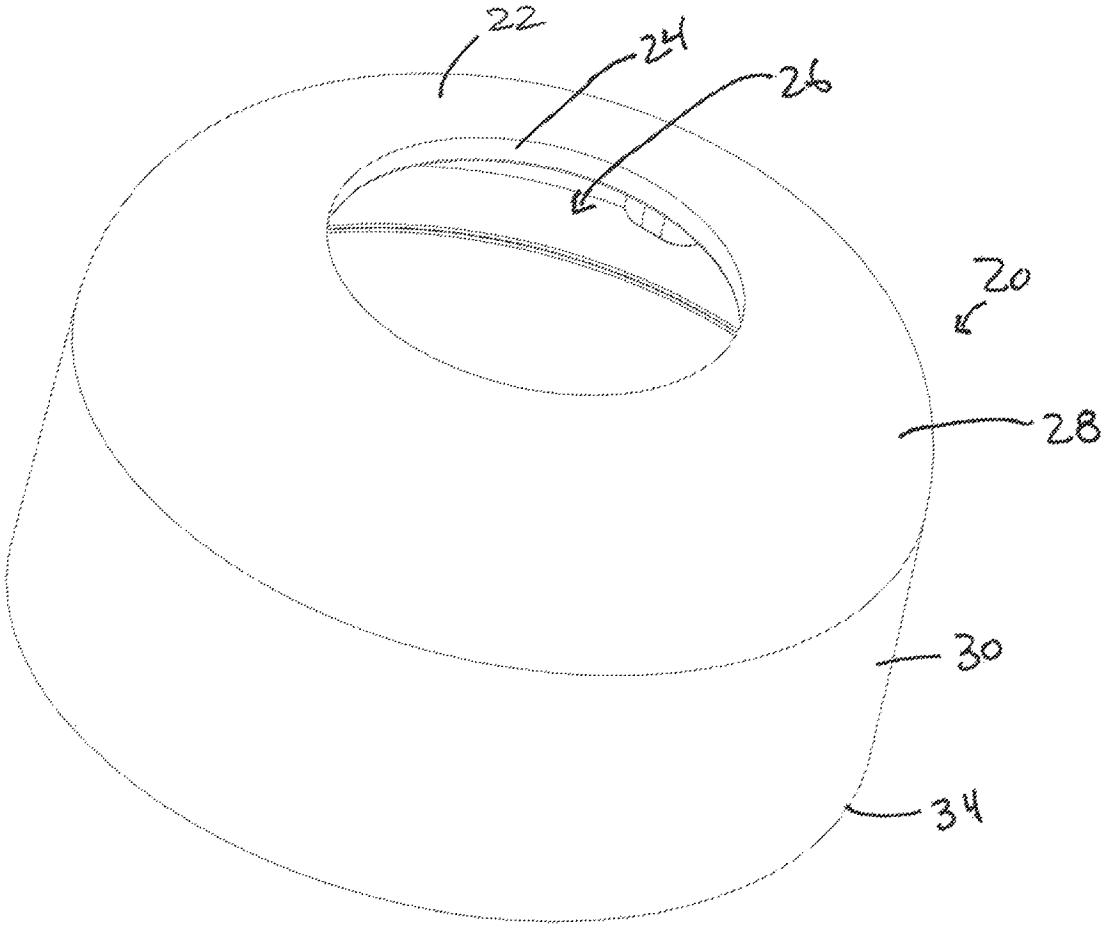
FIG. 7 is a perspective view of the collar in accordance with an embodiment of the present invention.
Figure 8:
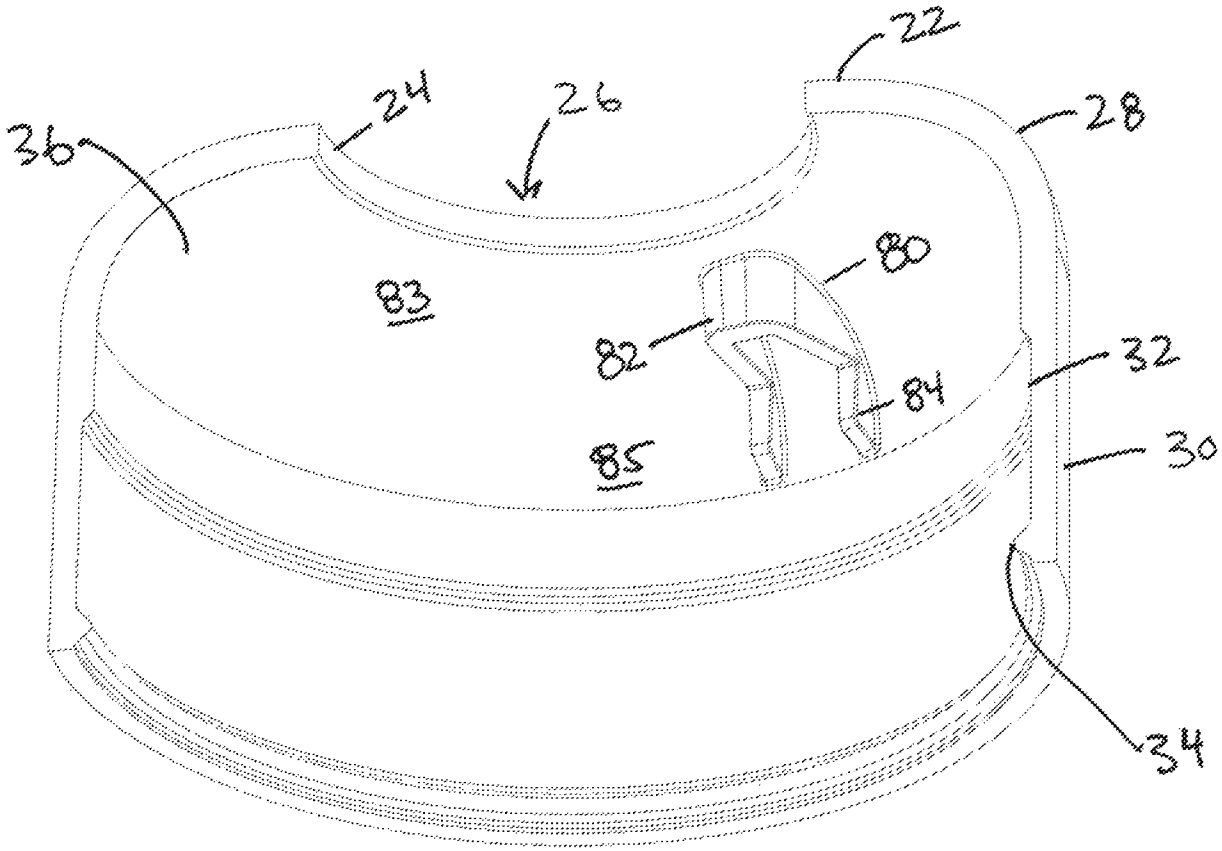
FIG. 8 is a sectional view of the collar in accordance with an embodiment of the present invention.
Figure 9:
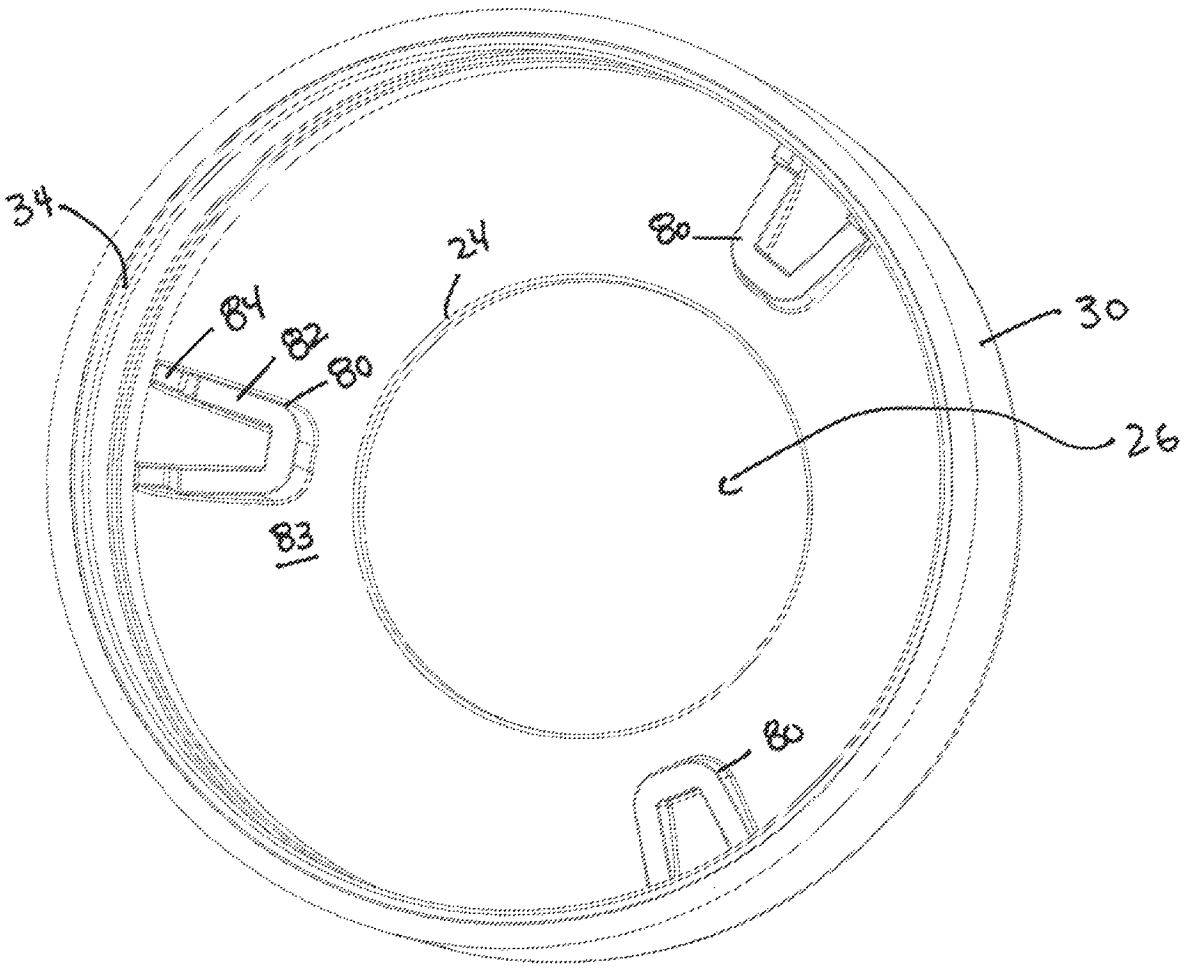
FIG. 9 is a view of the collar from underneath the collar in accordance with an embodiment of the present invention.
Figure 10:
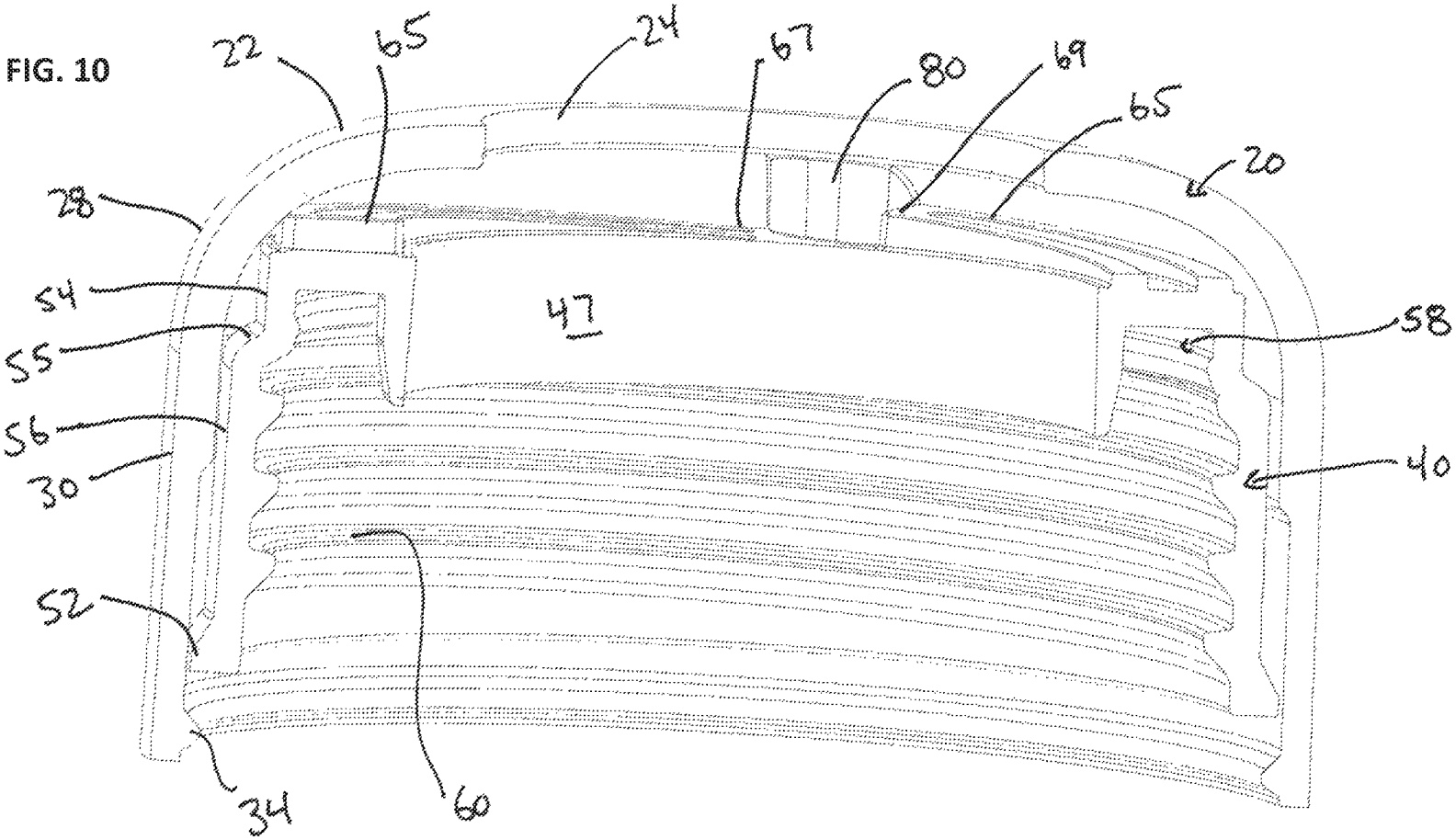
FIG. 10 is a sectional view of the collar and the closure cap assembled together in accordance with an embodiment of the present invention.

Referring now to the figures, FIGS. 1 through 10 there is a shown a closed non-refillable dispenser 10. The dispenser is referred to as non-refillable because once assembled and once the closure cap is fixed onto the dispenser bottle 12, the closure cap is non-removable, which prevents the dispenser bottle 12 from being refilled with a liquid. The dispenser 10 includes a pump assembly 15 similarly configured to those well known in the art, such would include a tube 17 extending into the bottle 12 and connected to a pump mechanism 18 that is actuated by pressing downwardly onto an actuator head 19. The pump assembly 15 is fixed to the bottle 12 with a closure cap 40. The closure cap 40 is non-removable once secured onto the bottle by the inclusion of a slip collar 20.

The slip collar 20 works in concert with the closure cap 40 to initially assist the manufacturer or assembly line in securing the closure cap 40 onto the bottle 12, but once secured, the slip collar 20 cannot be used to remove the closure cap 40 from the bottle. Thus, the closure cap 40 once fixed onto the dispenser becomes non-removable.

The closure cap 40 includes a top ledge 42 having an inner terminal edge 44 to define an annular opening 46 through which the pump assembly 15 can be inserted. In addition, the top ledge 42 has an outer terminal edge 46, from which a side wall 48 extends downwardly therefrom. The lower edge 50 of the side wall 48 further includes an annular flange 52. In addition, the side wall 48 may be further defined to include an upper side wall section 54 and a lower side wall projection section 56 that is projected outwardly by a lip 55 from the upper side wall section 54. The lower side wall projection section 56 extending to the lower edge 50 and thus to the annular flange 52.

From the inner terminal edge 44, there is an inner skirt 47 that extends downwardly therefrom. The combined inner skirt 47 and the side wall 48 define an interior channel 58 there-between that is configured to capture a rim 13 or neck of the bottle opening 14. To secure the closure cap 40 onto the bottle 12, the closure cap 40 includes interior threads 60 that work with exterior threads on the neck of the bottle.

Continuing to refer to the closure cap 40, the top ledge 42 has a plurality of ramps 65. Preferably there are at least two ramps 65, but for illustration purposes there is shown three. Each ramp 65 has an entrance portion 67 that starts flush with a surface area 43 of the top ledge 42. Each ramp 65 is an arcuate segmented ramp 65 that extends radially around the top ledge 42 for about 90-110 degrees, more preferably for about 100 degrees, and while increasing slightly in height. In addition, the ramps 65 travel or increase in height around the top ledge 42 in a counterclockwise direction. At the terminus end 69 of the ramp 65 the height of the ramp is only about 1.5 mm from the surface area 43 of the top ledge 42. The pitch of each ramp can be defined as: 5.4 mm pitch/revolution or each ramp can be defined by a helix angle of 2.89 degrees.

In other embodiments, each ramp 65 may be defined by having a pair of legs 70 separately extend from the surface area 43 of the top ledge 42 and extend in an arcuate segment around the top ledge 42 for about 100 degrees, and ending at a joining segment 72 defined about the terminus end 69 at a height of about 1.5 mmm from the surface area 43 of the top ledge 42.

As mentioned working in concert with the closure cap 40 is the slip collar 20. The slip collar 20 includes a collar top 22 with an inside terminal edge 24 to define a collar opening 26 configured to fit around a portion of the pump mechanism 15. The collar top 22 extends downwardly through a shoulder section 28 to a downwardly extending collar wall 30. The collar wall 30 includes a lower interior surface 32 that has defined an inwardly protruding bottom collar retaining edge 34. The collar top 22 and shoulder section 28 also has an upper interior surface 36. A plurality of interior cap protrusions 80 are provided on the upper interior surface 36 and which extend inwardly. In the preferred embodiment, there is illustrated three cap protrusions 80 positioned at about equal distances from each other and more preferably one cap protrusion 80 defined for a corresponding ramp 65. The cap protrusions 80 include a first protrusion member 82 positioned on a first section 83 of the upper interior surface 36 that corresponds to the collar top 22 such that the first protrusion member 82 is configured project downwardly to engage the ramp terminus end 69 of the ramp 65 when the collar 20 is pressed downwardly towards the closure cap 40 and rotated clockwise to tighten the closure cap onto the bottle 12. Once the closure cap is secured and fixed onto the bottle 12, rotation of the collar 20 in a counterclockwise direction does not loosen the closure cap, because the first protrusion member 82 would rotate over the entrance portion 67 of the ramp 65 and thus continue to freely rotate without engaging the closure cap. In addition, because the pitch of the ramp is so small it is nearly impossible to apply pressure to the top of the collar 20 that would cause it to engage the closure cap in the clockwise direction.

The cap protrusion 80 further includes a second protrusion member 84 extending along the a second section 85 of the upper interior surface 36 that corresponds to the shoulder section 28. In one embodiment the second protrusion member 84 is a pair of protruding legs 84' extending downwardly from the first protrusion member 82 and along the second section 85 of the upper interior surface 36. The second protrusion member 84 is configured to position against the upper side wall section 54 above the lip 55. This provides an alignment positioning between the collar 20 and the closure cap 40.

In addition, working in concert together, the protruding bottom collar retaining edge 34 extends inwardly while the annular flange 52 of the lower edge 50 of the side wall 48 extends outwardly both a predetermined distance to ensure that once the collar 20 is fitted over the closure cap 40 the collar 20 is non-removable. This prevents the user from gaining direct access to the closure cap 40.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A closed non-refillable dispenser comprising:

a bottle configured to hold a liquid and having a neck with a thread portion, the neck further surrounding an opening for access to the liquid;

a pump assembly fitted to the neck of the bottle and configured to manually pump liquid out of the bottle;

a closure cap fitted over the neck of the bottle and having a central closure opening to receive the pump assembly; and a collar seated entirely over the closure cap, the collar and the closure cap have corresponding engaging means configured to tighten the closure cap onto the neck when the collar is rotated in a clockwise direction and the collar being further configured to not engage the closure cap when the collar is rotated in a counterclockwise direction such that the closure cap is non-removably affixed to the bottle, thereby preventing the bottle from being refillable, and wherein the top ledge of the closure cap further includes:

a plurality of ramps, each ramp has an entrance portion that is substantially flush with a surface area of the top ledge, each ramp is defined as an arcuate segmented ramp that extends in a counterclockwise direction about the top ledge and increases in height from the entrance portion to a terminus end, and wherein each ramp is defined as having a pair of legs separately increasing in height from the entrance portion and extending in arcuate segments around the top edge to a segment that joins the two legs at the terminus end.

2. The dispenser of claim 1, wherein the closure cap includes:

a top ledge having an inner terminal edge configured to define the central closure opening, the top ledge further having an outer terminal edge;

a side wall extends downwardly from the outer terminal edge to a lower edge; and an annular flange extends outwardly from the lower edge of the side wall.

3. The dispenser of claim 2, wherein the side wall of the closure cap is further defined to have an upper side wall section and a lower side wall projection section that is projected outwardly by a lip from the upper side wall section.

4. The dispenser of claim 2 further including an inner skirt extending downwardly from the inner terminal edge of the top ledge to define an interior channel between the inner skirt and the side wall, the interior channel configured to capture a portion of the neck of the bottle.

5. The dispenser of claim 4 further includes mating threads on an interior surface of the side wall and on an exterior surface of the neck of the bottle.

6. The dispenser of claim 1, wherein the terminus end of each ramp is approximately 1.5 mm in height from the top ledge.

7. The dispenser of claim 1, wherein each ramp extends around the top ledge for about 100 degrees.

8. The dispenser of claim 1, wherein each ramp has a pitch defined as: 5.4 mm pitch/revolution.

9. The dispenser of claim 1, wherein each ramp has a helix angle of 2.89 degrees.

10. The dispenser of claim 1, wherein the collar includes:

a collar top with an inside terminal edge to define a collar opening configured to fit around a portion of the pump assembly over the central closure opening of the closure cap;

a shoulder section extends from the collar top to a downwardly extending collar wall, a bottom collar retaining edge inwardly protruding from a lower interior surface defined about the collar wall; and a plurality of interior cap protrusions extending inwardly from an upper interior surface defined about the collar top and shoulder section, wherein each of the ramps has a corresponding interior cap protrusion, and wherein when the collar is pressed downwardly towards the closure cap and rotated in the clockwise direction the cap protrusions engage the terminus ends of the ramps such that the closure cap rotates clockwise to tighten about the bottle, but when the collar is rotated in a counterclockwise direction the collar slips over the ramps preventing rotation of the closure cap in a counterclockwise direction, thereby defining a closure cap that is non-removably affixed to the bottle.

11. The dispenser of claim 10, wherein each of the cap protrusions includes a secondary protrusion member extending along an interior surface portion of the shoulder section, and wherein the secondary protrusion members are defined to position against an upper section of the side wall to center the closure cap around the neck.

12. The dispenser of claim 10, wherein the protruding bottom collar retaining edge extends inwardly to define a snap over fit engagement with the annular flange of the lower edge of the side wall such that the collar is non-removable from the closure cap.

13. A non-removable closure cap assembly for use with a non-refillable dispens herein the non-refillable dispenser includes a bottle configured to hold a liquid and having a neck with a thread portion, the neck further surrounding an opening for access to the liquid, and the non-refillable dispenser further includes a pump assembly fitted to the neck of the bottle and configured to manually pump liquid out of the bottle, the non-removable closure cap assembly comprising:

a closure cap fitted over the neck of the bottle and having a central closure opening to receive the pump assembly; and a collar seated entirely over the closure cap, the collar and the closure cap have corresponding engaging means configured to tighten the closure cap onto the neck when the collar is rotated in a clockwise direction and the collar being further configured to not engage the closure cap when the collar is rotated in a counterclockwise direction such that the closure cap is non-removably affixed to the bottle, thereby preventing the bottle from being refillable; and wherein the closure cap is defined to include:

a top ledge having an inner terminal edge configured to define the central closure opening, the top ledge further having an outer terminal edge, the top ledge further having a plurality of ramps, each ramp has an entrance portion that is substantially flush with a surface area of the top ledge, each ramp is defined as an arcuate segmented ramp that extends in a counterclockwise direction about the top ledge and increases in height from the entrance portion to a terminus end, a side wall extends downwardly from the outer terminal edge to a lower edge, an annular flange extends outwardly from the lower edge of the side wall, and an inner skirt extending downwardly from the inner terminal edge of the top ledge to define an interior channel between the inner skirt and the side wall, the interior channel configured to capture a portion of the neck of the bottle, and wherein each ramp is defined as having a pair of legs separately increasing in height from the entrance portion and extending in arcuate segments around the top edge to a segment that joins the two legs at the terminus end.

14. The non-removable closure cap assembly of claim 13, wherein the collar includes:

a collar top with an inside terminal edge to define a collar opening configured to fit around a portion of the pump assembly over the central closure opening of the closure cap;

a shoulder section extends from the collar top to a downwardly extending collar wall, a bottom collar retaining edge inwardly protruding from a lower interior surface defined about the collar wall; and a plurality of interior cap protrusions extending inwardly from an upper interior surface defined about the collar top and shoulder section, wherein each of the ramps has a corresponding interior cap protrusion, and wherein when the collar is pressed downwardly towards the closure cap and rotated in the clockwise direction the cap protrusions engage the terminus ends of the ramps such that the closure cap rotates clockwise to tighten about the bottle, but when the collar is rotated in a counterclockwise direction the collar slips over the ramps preventing rotation of the closure cap in a counterclockwise direction, thereby defining a closure cap that is non-removably affixed to the bottle.

15. The non-removable closure cap assembly of claim 14, wherein the protruding bottom collar retaining edge extends inwardly to define a snap over fit engagement with the annular flange of the lower edge of the side wall such that the collar is non-removable from the closure cap.

* * * * *